US005944556A

United States Patent [19]

Wlos et al.

[11] Patent Number: 5,944,556

[45] Date of Patent: Aug. 31, 1999

[54] CONNECTOR FOR COAXIAL CABLE

[75] Inventors: James J. Wlos, Park Forest; John H. Dykstra, Tinley Park; James C. Kirk, Tinley Park; Jeffrey Paynter, Tinley Park, all of Ill.

[73] Assignee: Andrew Corporation, Orland Park, Ill.

[21] Appl. No.: 08/835,309

[22] Filed: Apr. 7, 1997

[51] Int. Cl.[6] ..... H01R 9/07

[52] U.S. Cl. ..... 439/583

[58] Field of Search ..... 439/583, 578, 439/584

[56] References Cited

U.S. PATENT DOCUMENTS

| | | | |
|---|---|---|---|
| 3,199,061 | 8/1965 | Johnson et al. | 339/100 |
| 3,291,895 | 12/1966 | Van Dyke | 174/88 |
| 3,394,400 | 7/1968 | Lamons | 174/102 |
| 3,461,409 | 8/1969 | Miller | 333/96 |
| 4,046,451 | 9/1977 | Juds et al. | 339/177 |
| 4,491,685 | 1/1985 | Drew et al. | 439/584 |
| 4,583,811 | 4/1986 | McMills | 439/584 |
| 4,718,864 | 1/1988 | Flanagan | 439/578 |
| 4,800,351 | 1/1989 | Rampalli et al. | 333/237 |
| 4,824,400 | 4/1989 | Spinner | 439/578 |
| 4,910,998 | 3/1990 | Willis et al. | 73/40.5 R |
| 5,021,010 | 6/1991 | Wright | 439/578 |
| 5,063,659 | 11/1991 | Wright | 29/860 |
| 5,110,308 | 5/1992 | Nishikawa et al. | 439/582 |
| 5,137,470 | 8/1992 | Doles | 439/578 |
| 5,154,636 | 10/1992 | Vaccaro et al. | 439/583 |
| 5,167,532 | 12/1992 | Bruno et al. | 439/578 |
| 5,167,533 | 12/1992 | Rauwolf | 439/583 |
| 5,207,596 | 5/1995 | Tran | 439/78 |
| 5,232,377 | 8/1993 | Leibfried, Jr. | 439/320 |
| 5,281,167 | 1/1994 | Le et al. | 439/578 |
| 5,284,449 | 2/1994 | Vaccaro | 439/583 |
| 5,334,051 | 8/1994 | Devine et al. | 439/583 |
| 5,352,134 | 10/1994 | Jacobsen et al. | 439/584 |
| 5,354,217 | 10/1994 | Gabel et al. | 439/578 |
| 5,422,614 | 6/1995 | Rampalli et al. | 439/584 |
| 5,435,745 | 7/1995 | Booth | 439/584 |
| 5,518,420 | 5/1996 | Pitschi | 439/578 |
| 5,561,900 | 10/1996 | Hosler, Sr. | 29/828 |
| 5,795,188 | 8/1998 | Harwath | 439/583 |
| 5,871,372 | 2/1999 | Kanda et al. | 439/583 |

FOREIGN PATENT DOCUMENTS

| | | |
|---|---|---|
| 0 576 785 A2 | 3/1993 | European Pat. Off. . |
| 0 449 817 B1 | 5/1993 | European Pat. Off. . |
| 976127 | 10/1963 | United Kingdom . |
| 1447552 | 8/1976 | United Kingdom . |
| 1 490 421 | 11/1977 | United Kingdom . |
| 2175150 | 11/1986 | United Kingdom . |
| 2 277 207 | 3/1994 | United Kingdom . |
| 2317274 | 3/1998 | United Kingdom . |

*Primary Examiner*—Paula Bradley
*Assistant Examiner*—Tho D. Ta
*Attorney, Agent, or Firm*—Arnold, White & Durkee

[57] ABSTRACT

A connector assembly for a coaxial cable having an outer conductor, an inner conductor, and a dielectric spacer between the two conductors. The connector comprises a generally cylindrical outer connector adapted to be mounted on the outer surface of an end portion of the outer conductor and having a hollow extension projecting in a generally axial direction beyond the end of the outer conductor. An electrically conductive contact ring is disposed within the hollow interior of the extension of the outer connector, and the ring is mounted for movement in a generally axial direction within and relative to the outer connector for engaging the end of the outer conductor. A generally cylindrical body member telescopes over the extension of the outer connector, and the body member and the outer connector have cooperating threaded surfaces for joining the two members. The body member includes an internal boss for engaging the contact ring and advancing the ring against the end of the outer conductor to crush an end portion of the outer conductor as the body member is threaded onto the outer connector. An inner connector is mounted within the body member for engaging the inner conductor as the body member is threaded onto the outer connector.

20 Claims, 11 Drawing Sheets

CONNECTOR FOR COAXIAL CABLE

FIELD OF THE INVENTION

The present invention relates generally to connectors for coaxial cables and, more particularly, to improved connectors that are particularly quick and easy to install.

SUMMARY OF THE INVENTION

It is a primary object of the present invention to provide an improved coaxial cable connector which can be easily and quickly installed on a coaxial cable. In this connection, a related object of one aspect of this invention is to provide such an improved connector which is self-positioning when applied to the cable, without the use of saw guides or manual positioning of individual parts of the connector.

A further object of one aspect of this invention is to provide such an improved connector which requires only two pieces to be applied to the cable to form the complete connector assembly.

It is another object of the invention to provide such an improved connector which can be efficiently and economically manufactured at a lower cost than previous connectors.

Still another object of the invention is to provide such an improved connector which simplifies and facilitates the cable preparation required prior to the installation of the connector. Thus, a related object is to provide such a connector that permits the cable trim dimensions to be standardized for all connectors embodying this invention.

An important object of one particular embodiment of the invention is to provide an improved coaxial cable connector that includes an elbow that permits the cable to be connected to a device that is oriented at an angle to the cable, while permitting the elbow to be indexed to any of a multiplicity of different azimuthal positions around the axis of the cable.

Other objects and advantages of the invention will be apparent from the following detailed description and the accompanying drawings.

In accordance with the present invention, many of the foregoing objectives are realized by providing an improved coaxial cable connector comprising a generally cylindrical outer connector adapted to be mounted on the outer surface of an end portion of the outer conductor of the cable and having a hollow extension projecting in a generally axial direction beyond the end of the outer conductor; an electrically conductive contact ring disposed within the hollow interior of the extension of the outer connector, the ring being mounted for movement in a generally axial direction within and relative to the outer connector for engaging the end of the outer conductor; a generally cylindrical body member adapted to telescope over the extension of the outer connector, the body member and the outer connector having cooperating threaded surfaces for joining the two members, the body member including an internal boss for engaging the contact ring and advancing the ring against the end of the outer conductor to crush an end portion of the outer conductor as the body member is threaded onto the outer connector; and an inner connector mounted within the body member for engaging the inner conductor as the body member is threaded onto the outer connector.

In certain embodiments of the invention, rotation of the contact ring during tightening is prevented by anti-rotational locking means that prevents rotation of the contact ring as the contact ring is advanced against the end of the outer conductor.

One preferred embodiment of the invention provides an elbow connector comprising a generally cylindrical outer connector adapted to be mounted on the outer surface of an end portion of the outer conductor of the cable, at least a portion of the outer surface of the outer connector having a non-circular transverse cross-section; an electrically conductive elbow member adapted at one end to telescope over at least that portion of the outer connector having a non-circular transverse cross-section, at least a portion of the interior surface of the telescoping portion of the elbow member having a non-circular transverse cross-section that mates with that of the outer connector in different angular positions around the axis of the outer conductor to form an anti-rotational connection in any of the different angular positions; means for drawing the outer connector and the elbow member together, and holding them together; and an elbow-shaped inner connector mounted within the outer elbow member for engaging the inner conductor of the cable as the outer elbow member is telescoped onto the outer connector.

DETAILED DESCRIPTION OF THE PREFERRED EMBODIMENT

Figure 1:
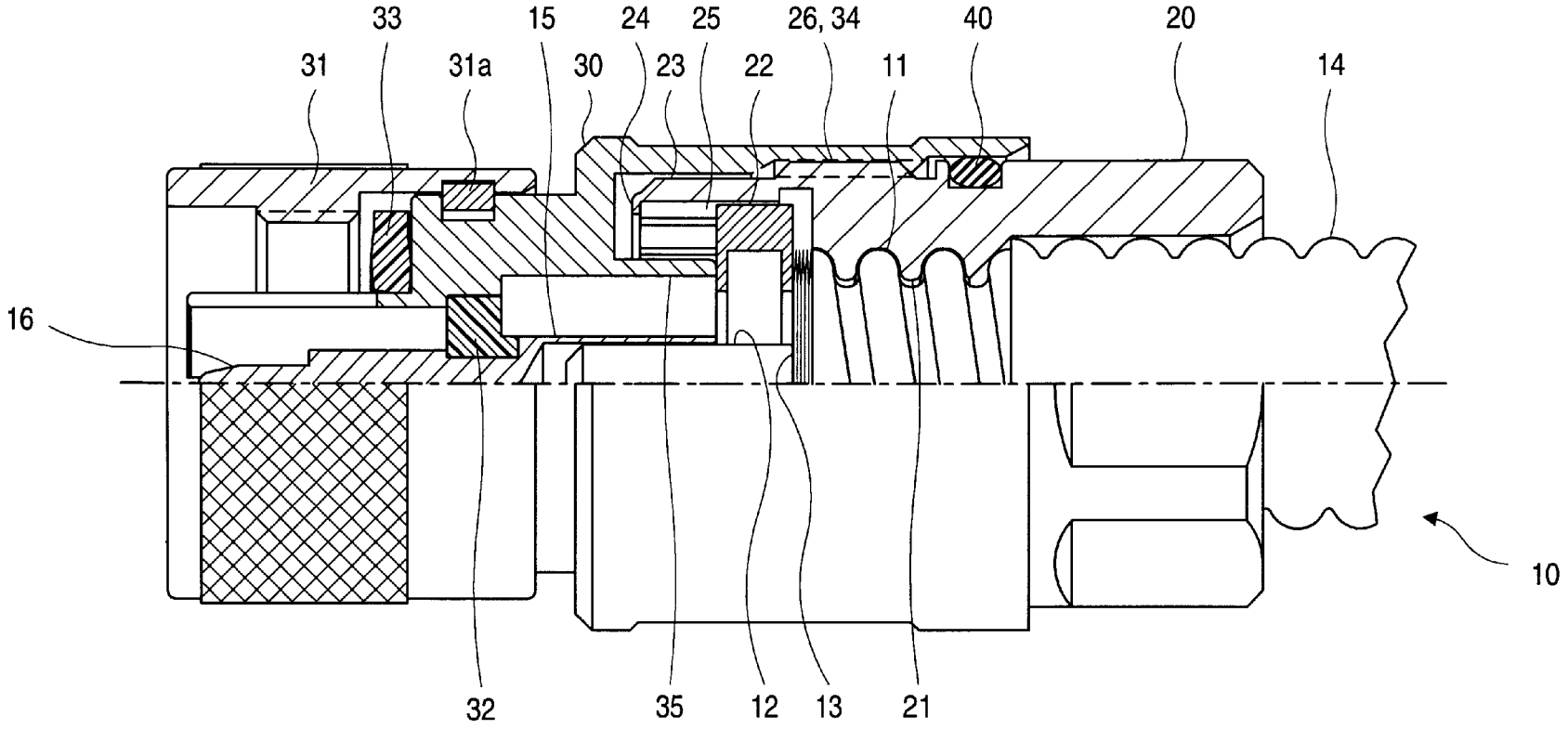
FIG. 1 is a side elevation, partially in section, of a first embodiment of a connector assembly embodying the present invention, fully assembled on the end of a coaxial cable.

While the invention is susceptible to various modifications and alternative forms, specific embodiments thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

Figure 2:
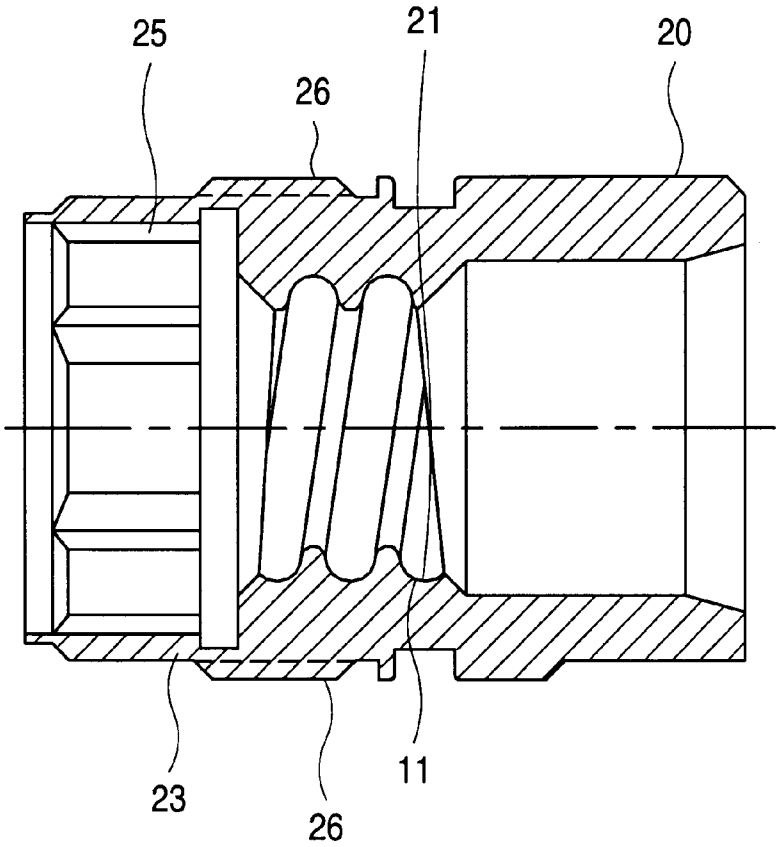
FIG. 2 is a longitudinal sectional view of the outer connector in the connector assembly of FIG. 1.
Figure 3:
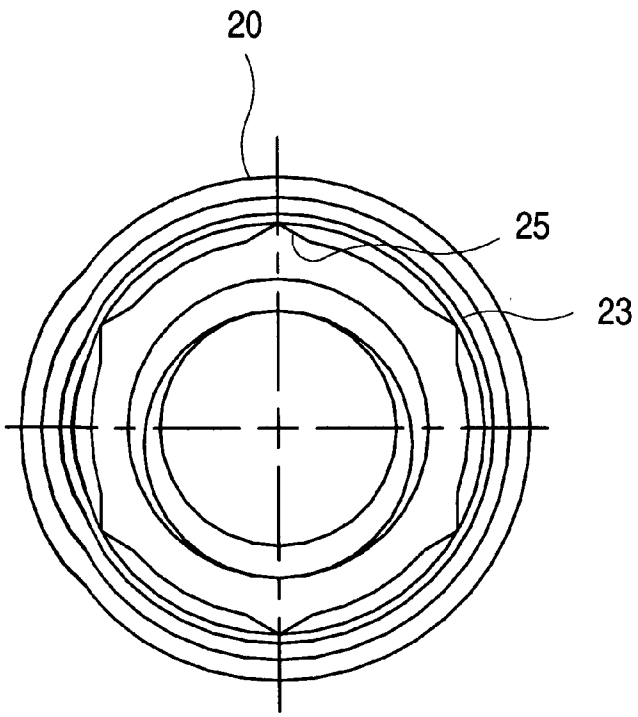
FIG. 3 is an end elevation of the outer connector of FIG. 2.
Figure 4:
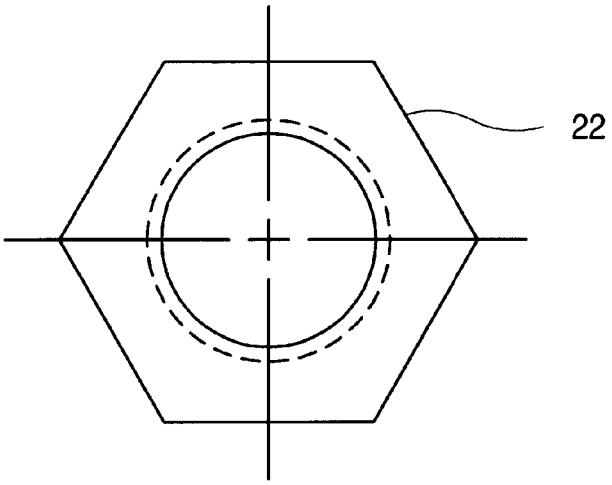
FIG. 4 is an end elevation of the contact ring in the connector assembly of FIG. 1.
Figure 5:
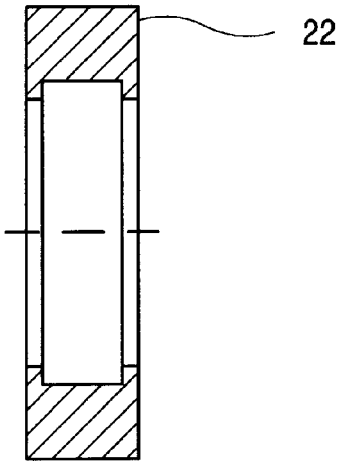
FIG. 5 is a vertical section taken through the middle of the contact ring of FIG. 4.
Figure 6:
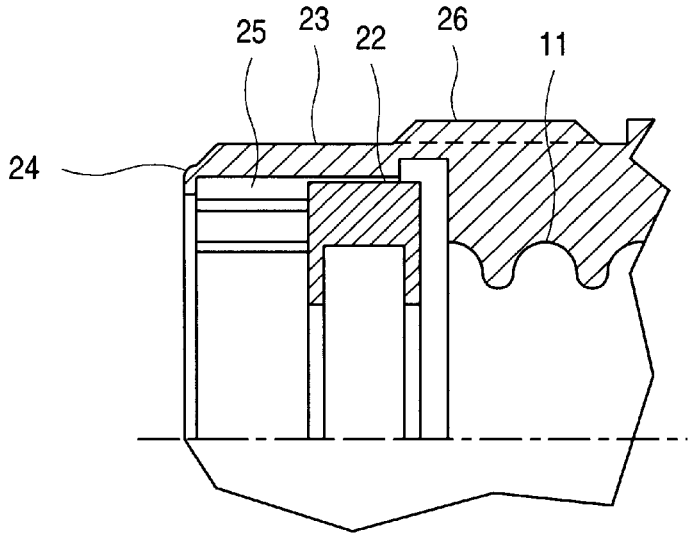
FIG. 6 is a fragmentary sectional view of a sub-assembly of the outer connector and the contact ring in the connector assembly of FIG. 1.
Figure 7:
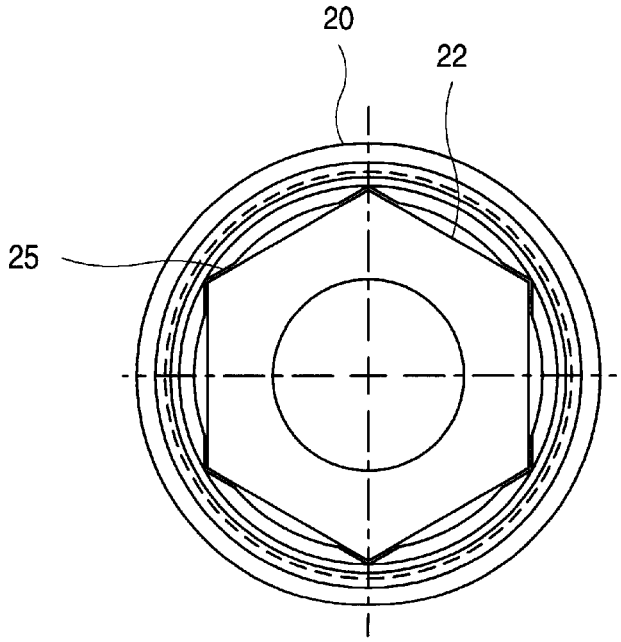
FIG. 7 is an end elevation of the sub-assembly of FIG. 6.

Turning now to the drawings and referring first to FIGS. 1 and 2, there is shown a connector assembly for a coaxial cable 10 having a helically corrugated outer conductor 11 concentrically spaced from an inner conductor 12 by a dielectric spacer (not shown). To prepare the cable 10 for attachment of the connector assembly, the end of the cable is cut along a plane that is perpendicular to the axis of the cable, and then the outer conductor 11 and the dielectric are cut along a second perpendicular plane to leave a short length (e.g., 0.25 inch) of the inner conductor 12 exposed at the end of the cable. Any burrs or rough edges on the cut ends of the metal conductors 11 and 12 are preferably removed to avoid interference with the connector. The outer surface of the outer conductor 11 is normally covered with a plastic jacket 14 which is trimmed away from the end of the outer conductor 11 along a sufficient length to accommodate the connector assembly.

Electrical contact with the inner conductor 12 of the cable 10 is effected by a conventional inner connector 15 which telescopes over, in sliding frictional engagement with, a substantial portion of the exposed length of the inner conductor 12. The head 16 of the inner connector 15 forms the male portion of a conventional connector.

Figure 8:
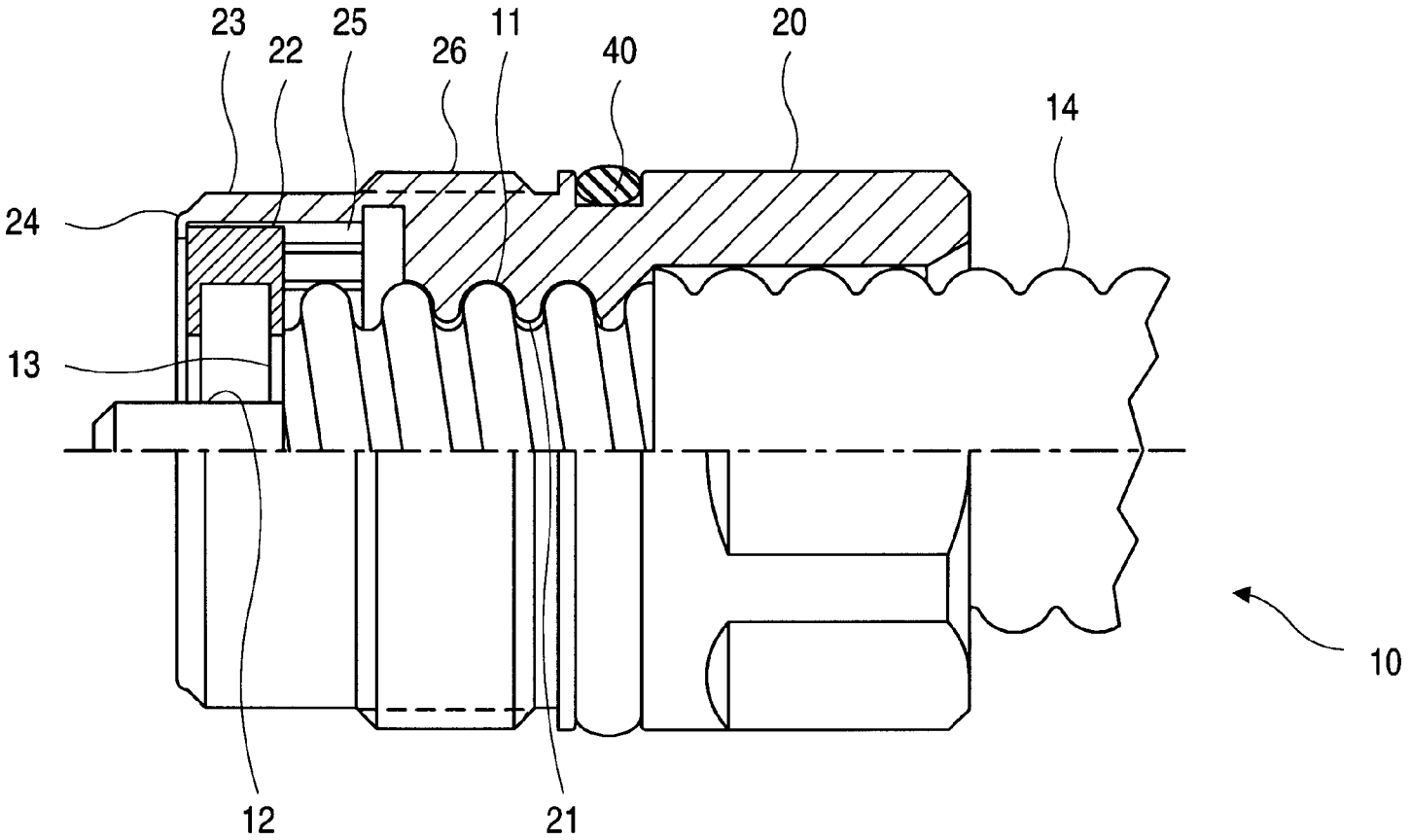
FIG. 8 is a side elevation, partially in section, of the subassembly of FIGS. 6 and 7, fully assembled on the end of a coaxial cable.
Figure 9:
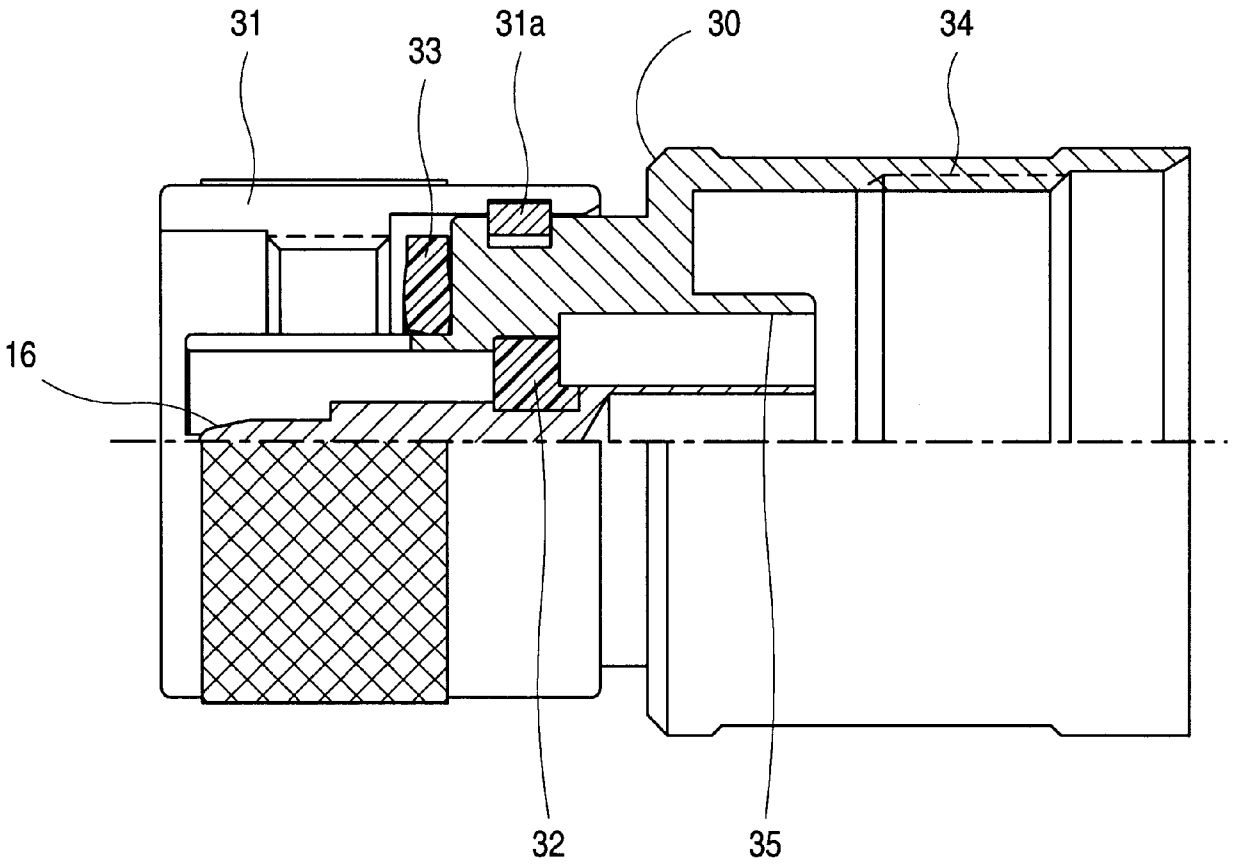
FIG. 9 is a side elevation, partially in section, of the subassembly of the inner connector and body member in the connector assembly of FIG. 1.
Figure 10A:
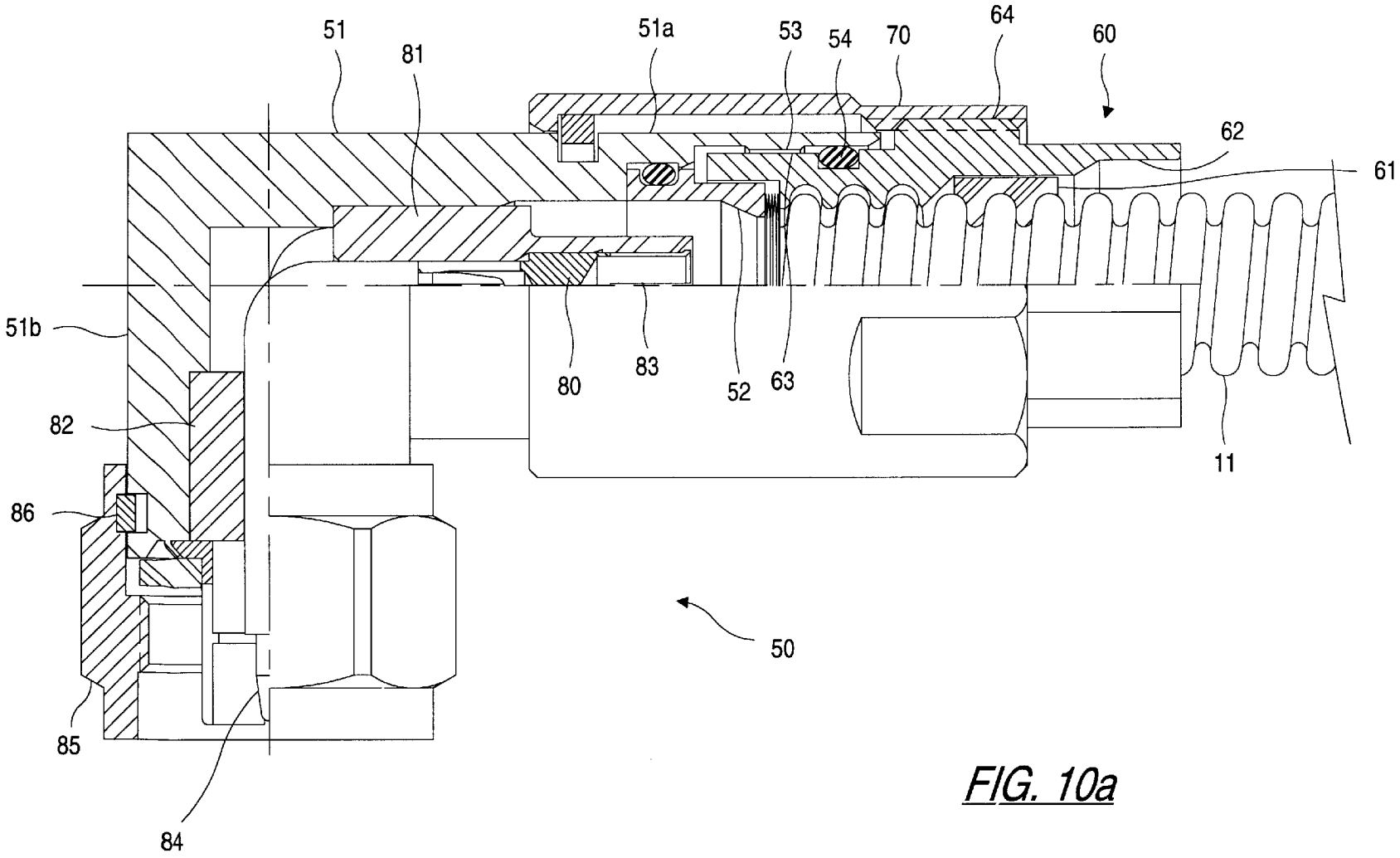
FIG. 10*a* is a side elevation, partially in section, of a second embodiment of a connector assembly embodying the present invention, fully assembled with the contact ring in its retracted position.
Figure 10B:
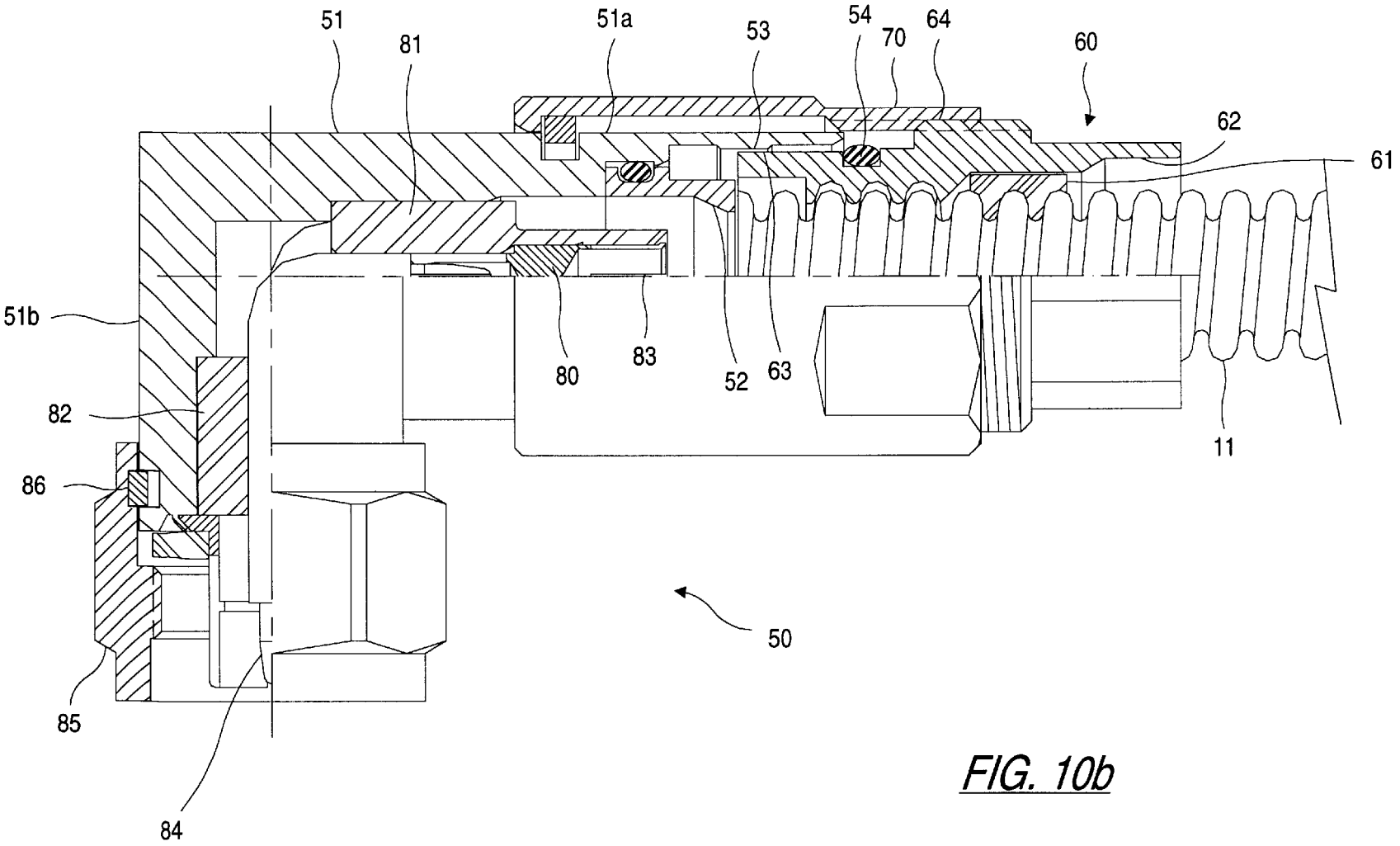
FIG. 10*b* is the same side elevation shown in FIG. 10*a* with the contact ring in its advanced position.
Figure 12:
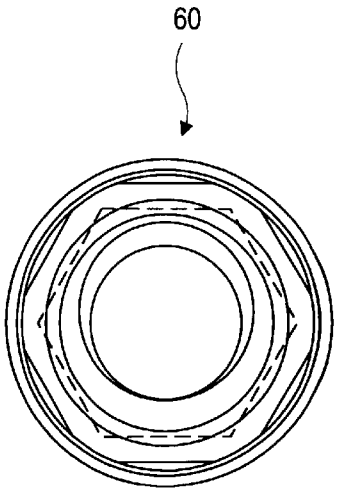
FIG. 12 is an end elevation of the right-hand end of the outer connector shown in FIG. 11.
Figure 11:
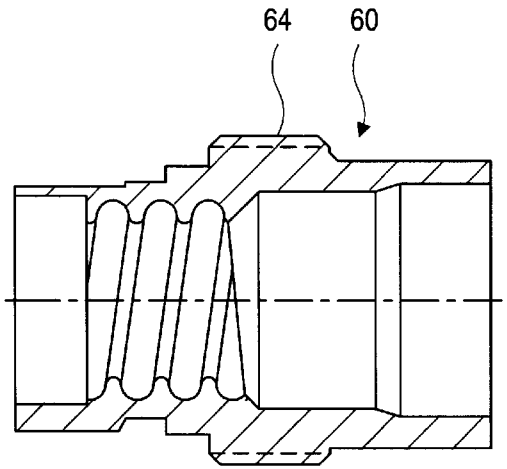
FIG. 11 is a longitudinal sectional view of the outer connector in the connector assembly of FIGS. 10*a* and 10*b*, taken along line 11—11 in FIG. 13.
Figure 13:
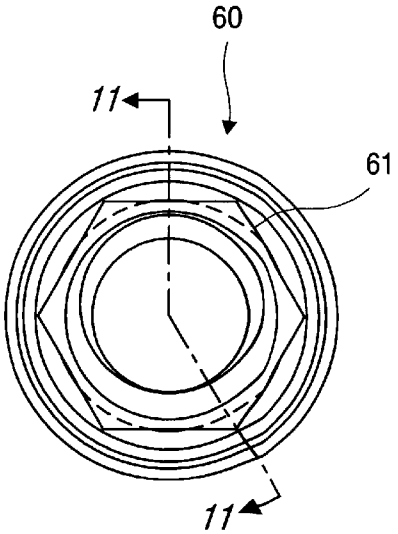
FIG. 13 is an end elevation of the left-hand end of the outer connector shown in FIG. 11.
Figure 16:
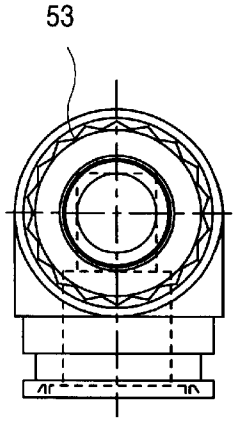
FIG. 16 is an end elevation of the right-hand end of the elbow member shown in FIG. 15.
Figure 14:
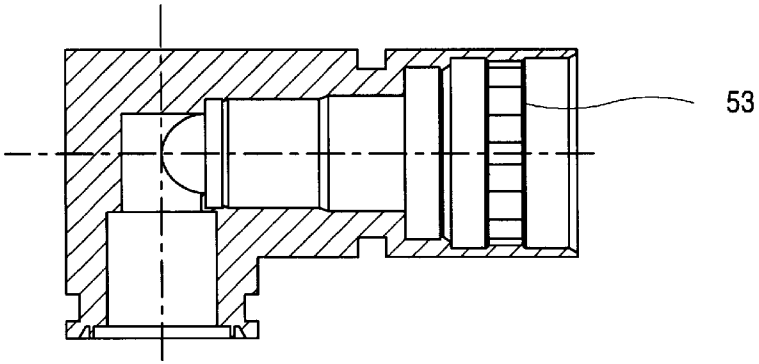
FIG. 14 is a longitudinal sectional view of the elbow member in the connector assembly of FIGS. 10*a* and 10*b;*
Figure 15:
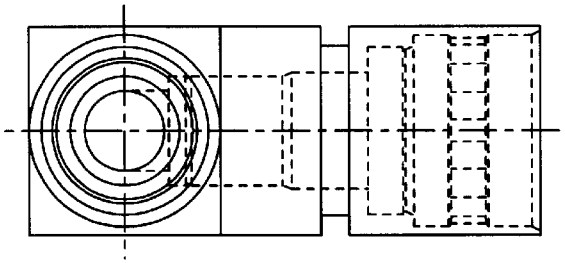
FIG. 15 is a side elevation of the elbow member shown in FIG. 14.
Figure 17:
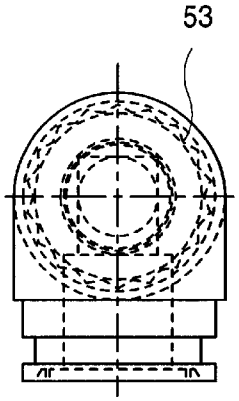
FIG. 17 is an end elevation of the left-hand end of the elbow member shown in FIG. 15.
Figure 19:
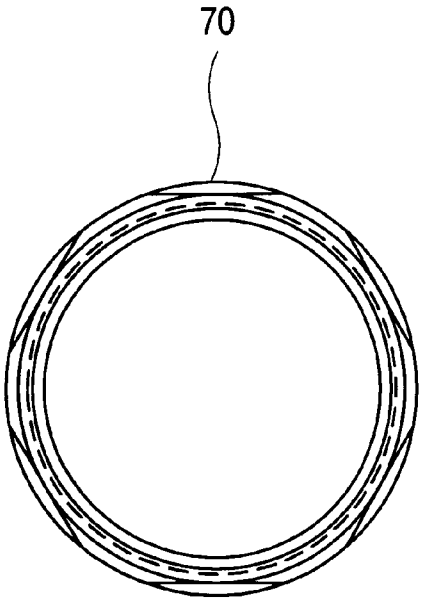
* and FIG. 19 is an end elevation of the right-hand end of the outer sleeve shown in FIG. 18.
Figure 18:
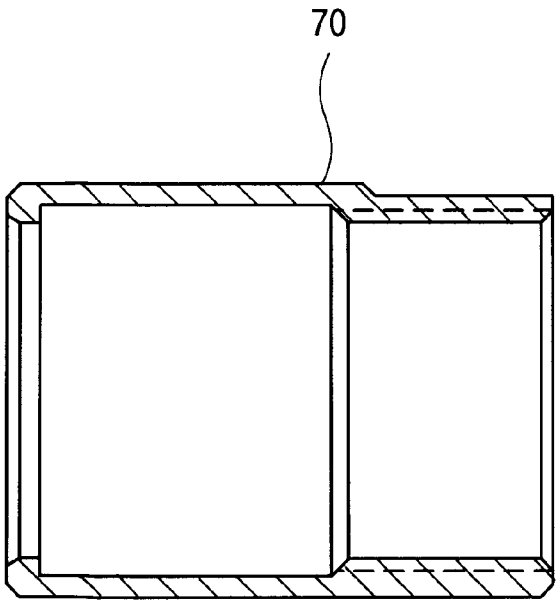
FIG. 18 is a longitudinal section of the outer sleeve in the connector assembly of FIGS. 10*a* and 10*b.

The first part of the connector assembly to be installed on the coaxial cable is an outer connector 20 which has a threaded inner surface 21 that matches the helical corrugations of the outer conductor 11. Thus, the connector 20 can be threaded onto the outer conductor 11 until an inside surface of the connector engages the cut end 13 (FIG. 8) of the outer conductor 11. As will be discussed in detail below, the initial contact between the outer conductor 11 and the connector occurs when the cut end 13 of the outer conductor engages an electrically conductive brass contact ring 22 captured a cylindrical extension 23 of the connector 20.

After initial engagement between the contact ring 22 and the end of the outer conductor 11, continued advancement of the connector 20 onto the cable pushes the ring 22 firmly against an inner lip 24 at the end of the extension 23. To prevent rotation of the contact ring 22 within the cavity formed by the extension 23, thereby preventing detrimental cable rotation within the connector 20, the ring 22 and the inside surface of the extension 23 form meshing anti-rotational surfaces. Specifically, the contact ring 22 has a hexagonal shape, and the inside surface of the cylindrical extension 23 forms six longitudinal grooves 25 for receiving the six corners of the hexagonal contact ring 22. Thus, the contact ring 22 can slide longitudinally within the extension 23, but cannot rotate relative to the connector 20.

To complete the installation of the connector assembly, a stepped cylindrical body member 30 is threaded onto the connector 20. This body member 30 carries the inner connector 15, with a dielectric spacer 32 insulating the inner connector 15 and the body member 30. The reduced-diameter end portion of the body member 30 carries a coupling nut 31 that is secured to the body member 30 by a spring retaining ring 31*a*. The ring 31*a* holds the nut 31 captive on the body member 30 while permitting free rotation of the nut 31 on the body member. A gasket 33 is captured between the coupling nut 21 and a flat end surface on the body member 30 to provide an insulated sealing surface for a mating connector.

For the purpose of drawing the contact ring 22 firmly against the end of the outer conductor 11, the outer connector 20 and the body member 30 include cooperating threaded surfaces 26 and 34. Thus, when the body member 30 is threaded onto the outer connector 20, the two members are telescoped over each other in the axial direction so as to urge the contact ring 22 against the end 13 of the outer conductor 11.

As the body member 30 is threaded onto the outer connector 20, an internal boss 35 formed by the body member engages the contact ring 22 and presses it against the cut end of the outer conductor 11. Further advancement of the body member 30 onto the outer connector 20 then pushes the ring 22 longitudinally through the cavity formed by the extension 23, thereby crushing the corrugations of that portion of the outer conductor located within the extension 23. As illustrated in FIG. 1, advancement of the ring 22 continues until the crushed portion of the outer conductor is firmly compacted between the ring 22 and the internally threaded segment of the connector 20. This establishes a tight electrical connection between the outer conductor 11, the contact ring 22, and the body member 30. The inside diameter of the contact ring 22 is preferably about the same as the minor inside diameter of the outer conductor 11 to ensure contact with the maximum area of the crushed end portion of the outer conductor 11.

Although the entire body member 30, including the boss 35, is rotated during advancing movement of the contact ring 22, the anti-rotational lock between the ring 22 and the connector 20 prevents the ring 22 from rotating. This in turn prevents rotation of the coaxial cable, which would be detrimental because cable rotation could cause a portion of the cable to be retracted from the outer connector 20.

A moisture barrier is provided by an O-ring 40 positioned between the opposed surfaces of the members 20 and 30, respectively.

To maintain an impedance match to the cable 10 and to a mating connector, the conductive contact ring 22 and the body member 30 are constructed with internal dimensions which satisfy the following formula (which is well known in the art):

$$Zo = \frac{138\log(D/d)}{e_r^{1/2}}$$

where

Zo=the desired impedance of the coaxial connector;

D=the internal diameter of the conductive connector element;

d=the diameter of the inner conductor 12; and $e_r$=the relative permittivity of the dielectric sleeve 32.

A modified connector 50 embodying the invention is illustrated in FIGS. 10–19, for use in connecting a first coaxial cable to a second cable or other device that is oriented at an angle to the axis of the first cable. Thus, the connector 50 includes an outer elbow member 51 that is one part of a two-part contact member that also includes an inner ring 52. The inner ring 52 makes contact with the end of the outer conductor of the coaxial cable (not shown) and is also in electrical contact with the elbow member 51. In the illustrative embodiment, the elbow member 51 is a 90° elbow, i.e., the axes of the cylindrical sections 51*a* and 51*b* at opposite ends of the elbow member are perpendicular to each other.

The outer connector 60 in the embodiment of FIGS. 10–19 is similar to the outer connector 20 in the embodiment of FIGS. 1–9 in that both connectors have a threaded inner surface 61 or 21 that matches the helical corrugations of the outer conductor 11 of the coaxial cable. Thus, the connector 60 can be threaded onto the outer conductor 11 of the cable. To provide a moisture barrier between the inner surface of the connector 60 and the outer surface of the outer conductor 11, a gasket 61 is positioned within the cylindrical portion of the connector 60 behind the corrugated surface that mates with the corrugations of the outer conductor. The gasket 61 has a corrugated inner surface to match the helical corrugations of the outer conductor 11. When the connector 60 is threaded onto the outer conductor 11, the gasket 61 compresses slightly so that the gasket bears firmly against both the outer surface of the conductor 11 and the inner surface of the connector. The end portion 62 of the connector has a slightly increased inside diameter so that it can fit over the end of the polymeric jacket on the coaxial cable (see FIG. 1).

To permit the elbow member 51 to be locked in different angular positions around the axis of the outer connector 60, the exterior surface of the connector 60 includes a hexagonal section 63, and the interior surface of the telescoping cylindrical section 51*a* of the elbow 51 forms a multi-cornered socket 53 designed to mesh with the hexagonal surface 63 on the connector 60. In the illustrative embodiment, the socket 53 forms 18 corners so that the hexagonal surface 63 can receive the socket in 18 different angular positions, i.e., in increments of 20°, thereby enabling the elbow member 50 to be installed in any of 18 different angular positions relative to the connector 60. It will be understood that the number of corners on the non-circular locking surface 63 and in the socket 53 may be varied to provide the desired number of different angular positions, but the number of corners in the socket 53 is preferably a multiple (a whole integer) of the number of corners on the locking surface 63.

As the elbow member 51 and the connector 60 are telescoped together, the inner ring 52 telescopes into the interior of the connector 60 to engage the exposed end of the outer conductor of the cable. For the purpose of permitting rotational indexing movement of the elbow member 51 without rotating the inner ring 52, the elbow member 51 and the ring 52 are free to rotate relative to each other. Thus, the ring 52 can be advanced into engagement with the end of the outer conductor of the coaxial cable by moving the elbow member 51 longitudinally relative to the outer connector 60. An O-ring 54 seated in a groove in the outer surface of the connector 60 provides a moisture barrier between the elbow member 51 and the connector 60.

To effect the telescoping movement of the elbow member 51 and the connector 60, an outer sleeve 70 is attached at one end to the elbow member 51 and is threaded onto a raised threaded portion 64 on the outer surface of the outer connector 60 at its other end. Consequently, turning the sleeve 70 causes telescoping movement of the elbow member 50 and the outer connector 60 relative to each other, and when this movement is in the advancing direction, it also advances the inner ring 53 toward and against the end of the outer conductor of the coaxial cable. This advancing movement of the ring 53 crushes the corrugations in the length of outer conductor that extends beyond the internally threaded portion of the connector 60, in the same manner described above in connection with the connector assembly of FIGS. 1–9. This can be seen most clearly in FIGS. lO*a* and 10*b* which show the connector fully assembled with the contact ring in its retracted postion in FIG. 10*a* and in its advanced position in FIG. 10*b*.

The inner connector 80 in the embodiment of FIGS. 10–19 is also in the form of a 90° elbow and is separated from the outer elbow 51 by a pair of dielectric sleeves 81 and 82. The exposed end portion of the inner conductor of the coaxial cable fits into a hollow cylindrical portion 83, which in the illustrative embodiment is slotted to form a plurality of spring fingers to grip the inner conductor. The opposite end of the inner connector terminates in a standard male fitting 84 to mate with a cooperating fitting on the device to be attached to the coaxial cable. A standard coupling nut 85 is secured to the outer elbow member 51 by a conventional spring retaining ring 86 which holds the nut 85 captive on the member 51 while permitting free rotation of the nut 85 on the member 51.

As can be seen from the foregoing detailed description of the illustrative embodiments of the invention, the improved connector assemblies of this invention can be easily and quickly installed. These improved connectors are self-positioning when applied to a coaxial cable, without the use of saw guides or manual positioning of individual parts of the connector. The first preferred embodiment described above requires only two pieces to be applied to the cable to form the complete connector assembly. The second preferred embodiment permits the connector to be oriented at different angular positions on the coaxial cable. Both connectors can be efficiently and economically manufactured at a lower cost than most other comparable connectors for coaxial cables. The connectors of this invention also simplify and facilitate the cable preparation required prior to the installation of the connector, permitting the cable trim dimensions to be standardized for all connectors embodying this invention.

We claim:

1. A connector for a coaxial cable having a corrugated outer conductor, an inner conductor and a dielectric spacer between the two conductors, said connector comprising a generally cylindrical outer connector adapted to be mounted on an outer surface of an end portion of said corrugated outer conductor and having a hollow extension projecting in a generally axial direction beyond the end of said outer conductor, an electrically conductive contact ring disposed within said hollow extension of said outer connector, said ring being mounted for movement in a generally axial direction within and relative to said outer connector for engaging the end of said outer conductor, a generally cylindrical body member adapted to telescope over said extension of said outer connector, said body member and said outer connector having cooperating threaded surfaces for joining the body member to the outer connector, said body member including an internal boss for engaging said contact ring and axially advancing said ring against the end of said outer conductor to crush an end portion of said outer conductor as said body member is threaded onto said outer connector, and an inner connector mounted within said body member for engaging said inner conductor as said body member is threaded onto said outer connector.

2. The connector of claim 1 wherein said outer connector and said body member are made of electrically conductive material.

3. The connector of claim 1 wherein said inner connector includes a hollow cylindrical member for fitting over and frictionally engaging an exposed end portion of said inner conductor.

4. The connector of claim 1 wherein said contact ring and said extension of said outer connector have cooperating surfaces that prevent relative rotation between said contact ring and said outer connector as said contact ring is advanced against the end of said outer conductor.

5. The connector of claim 4 wherein said contact ring has a non-circular external shape forming a plurality of corners, and said hollow extension has a plurality of interior longitudinal grooves for receiving and guiding said corners formed by said contact ring.

6. The connector of claim 1 wherein said outer connector includes an inwardly extending lip on the end of said extension for capturing said contact ring within said extension, and for positioning a predetermined length of said outer conductor in said outer connector by defining a limit of retracting axial movement of said contact ring within said extension when said outer connector is advanced onto said outer conductor.

7. The connector of claim 6 wherein said internal boss on said body member extends longitudinally past said lip and into said hollow extension to engage said contact ring when said body member is telescoped over said extension.

8. The connector of claim 1 wherein said outer connector has an inner surface adapted to engage the corrugations of said outer conductor.

9. The connector of claim 8 wherein said outer conductor is helically corrugated, and has an inner surface portion threaded to match the helical corrugations of said outer conductor.

10. The combination of a coaxial cable having a corrugated outer conductor, an inner conductor and a dielectric spacer between the two conductors, and a connector comprising a generally cylindrical outer connector adapted to be mounted on an outer surface of an end portion of said outer conductor and having a hollow extension projecting in a generally axial direction beyond the end of said outer conductor, an electrically conductive contact ring disposed within said hollow extension of said outer connector, said ring being mounted for movement in a generally axial direction within and relative to said outer connector for engaging the end of said outer conductor, a generally cylindrical body member adapted to telescope over said extension of said outer connector, said body member and said outer connector having cooperating threaded surfaces for joining the body member and the outer connector, said body member including an internal boss for engaging said contact ring and axially advancing said ring against the end of said outer conductor to crush an end portion of said outer conductor as said body member is threaded onto said outer connector, and an inner connector mounted within said body member for engaging said inner conductor as said body member is threaded onto said outer connector.

11. A connector for a coaxial cable having an outer conductor, an inner conductor and a dielectric spacer between the two conductors, said connector comprising a generally cylindrical outer connector adapted to be mounted on an outer surface of an end portion of said outer conductor, an electrically conductive contact member adapted for telescoping cooperation with said outer connector, for movement in a generally axial direction relative to said outer connector for engaging the end of said outer conductor, a generally cylindrical body member adapted to telescope over the outer connector, said body member having means for engaging said contact member and axially advancing said contact member against the end of said outer conductor to crush an end portion of said outer conductor and make electrical contact therewith, anti-rotational means for preventing rotation of said contact member as said contact member is advanced against the end of said outer conductor, and an inner connector mounted within said body member for engaging said inner conductor as said body member is threaded onto said outer connector.

12. The connector of claim 11 wherein said outer connector has a threaded inner surface adapted to engage a corrugated outer conductor.

13. The connector of claim 11 wherein said means for drawing said outer connector and said contact member together comprises an outer sleeve attached to one of said outer connector and said contact member and in threaded engagement with the other.

14. The connector of claim 13 wherein said outer sleeve is attached to said contact member in a manner that permits relative movement therebetween in the longitudinal direction but prevents relative rotational movement therebetween.

15. The connector of claim 11 wherein said contact member comprises an inner ring for engaging the end of said outer conductor and making electrical contact therewith, and an elbow member having a cylindrical portion surrounding a portion of said outer connector to permit adjustment of the angular position of said elbow member without rotating said inner ring.

16. The connector of claim 15 wherein said cylindrical portion of said contact member telescopes over a portion of said outer connector, the opposed surfaces of said outer connector and said cylindrical portion of said elbow member forming said anti-rotational locking means.

17. The connector of claim 16 wherein the outer periphery of said outer connector has said non-circular shape, and the inner periphery of said cylindrical portion of said elbow member has said longitudinal grooves.

18. The connector of claim 16 wherein one of said opposed surfaces of said outer connector and said cylindrical portion of said elbow member has a non-circular shape forming a plurality of corners, and the other of said opposed surfaces has a plurality of longitudinal grooves for receiving said corners to permit longitudinal movement of said corners while preventing rotational movement thereof.

19. The connector of claim 16 wherein said corners and grooves are spaced around the peripheries of said outer connector and said cylindrical portion of said elbow member to permit said contact member to be indexed to different angular positions with respect to said outer connector.

20. The connector of claim 19 wherein both said corners and said grooves are evenly spaced around their respective peripheries, the number of said grooves is a multiple of the number of said corners, and said multiple is a whole integer.

* * * * *